United States Patent [19]

Tischler

[11] Patent Number: 4,838,128

[45] Date of Patent: Jun. 13, 1989

[54] CORKSCREW

[76] Inventor: Wolfgang Tischler, Weinbergstrasse 33, D-8740 Bad Neustadt/Saale, Fed. Rep. of Germany

[21] Appl. No.: 170,238

[22] Filed: Mar. 18, 1988

[30] Foreign Application Priority Data

Mar. 18, 1987 [DE] Fed. Rep. of Germany ... 8704060[U]

[51] Int. Cl.[4] ..... B67B 7/06

[52] U.S. Cl. ..... 81/3.48

[58] Field of Search ..... 81/3.48, 3.49, 3.47

[56] References Cited

U.S. PATENT DOCUMENTS 3,256,756 6/1966 Del Piccolo ..... 81/3.48

FOREIGN PATENT DOCUMENTS 7439782 5/1975 Fed. Rep. of Germany .

8624741 2/1987 Fed. Rep. of Germany .

747679 4/1933 France ..... 81/3.49

948650 1/1949 France ..... 81/3.48

*Primary Examiner*—Roscoe V. Parker

*Attorney, Agent, or Firm*—Fred Philpitt

[57] ABSTRACT

Corkscrew, consisting substantially of two handle parts each provided with a metal tongue and being mutually shiftable within a common guide sleeve. For uncorking a bottle, the two metal tongues are successively introduced between the cork and the bottle neck, under automatic centering. Thus the cork is clamped between the two metal tongues and can without damage thereto be pulled out of the bottle neck, combined with a rotatory motion.

4 Claims, 2 Drawing Sheets

I-I

CORKSCREW

This invention relates to a corkscrew.

A somewhat similar corkscrew is shown in DE-U-86 24 741.

With the prior art corkscrews, the metal tongues are arranged on a single-part handle piece so that in use, the metal tongues must be freely inserted between the cork and the bottle neck. As a rule, this is possible only with the help of the other hand since the spacing between the free ends of the metal tongues does not correspond to the diameter of the bottle opening. Furthermore, the two metal tongues of such a corkscrew must be introduced between cork and bottle neck by alternate lateral tilting of the handle piece. Still it may happen that a cork that has not been very tightly fixed is easily pushed into the bottle. On the other hand, where the cork has been tighltly fitted, a large effort will be required for inserting the tongues.

The invention is based on the desire to improve a corkscrew so that its handling is substantially facilitated. Further, despite facilitated handling, it is to be avoided to the greatest possible extent, that a rather lossely fitted cork be pushed in, and the effort required for introducing the metal tongues is to be reduced.

The solution to the problem posed is achieved by the present invention in that the shaft portion is movably arranged within a guide sleeve and that the guide sleeve is provided with a centering collar adapted to be placed onto the bottle neck. Thus the guide sleeve can be applied onto the bottle neck in a simple manner, and the shaft portion guided by it as well as the metal tongues and thus centered relative to the bottle opening.

By the features that the shaft portion is longitudinally divided into two shaft halves and that each shaft half comprises a handle tab and a metal tongue, it is possible to first introduce between the cork and bottle neck one metal tongue by shifting one shaft half and then to introduce the other metal tongue by shifting the other shaft half. Thereby, only half the force will be acting during the insertion of the first metal tongue so that it is avoided to the greatest possible extent to push the cork into the bottle even if it were rather loosely fitted. Thereafter, during the insertion of the second metal tongue, the cork is already additionally jammed by the first metal tongue, which provides additional safety against pushing in.

It is of special advantage for the handling of the corkscrew that within the guide sleeve, there is a guide ring which is recessed in an axial direction of the guide sleeve relative to the centering collar, the ring opening having a diameter that corresponds to the diameter of the bottle opening. Such a guide ring will serve as a stop when the corkscrew is applied, and due to its opening being adapted to the diameter of the bottle opening, the metal tongues are oriented precisely towards the clear width of the bottle opening so that the metal tongues can be introduced exactly between cork and bottle neck.

Owing to the feature that the metal tongues bulge inwards relative to their longitudinal axes, the cork is jammed so tightly that it can definitely be pullled out of the bottle neck.

The insertion of the metal tongues will be further facilitated if the metal tongues, which should be made of spring steel of high resilience, have pointed free ends.

The invention will be elucidated below with reference to an embodiment shown in the drawings herein:

Figure 1:
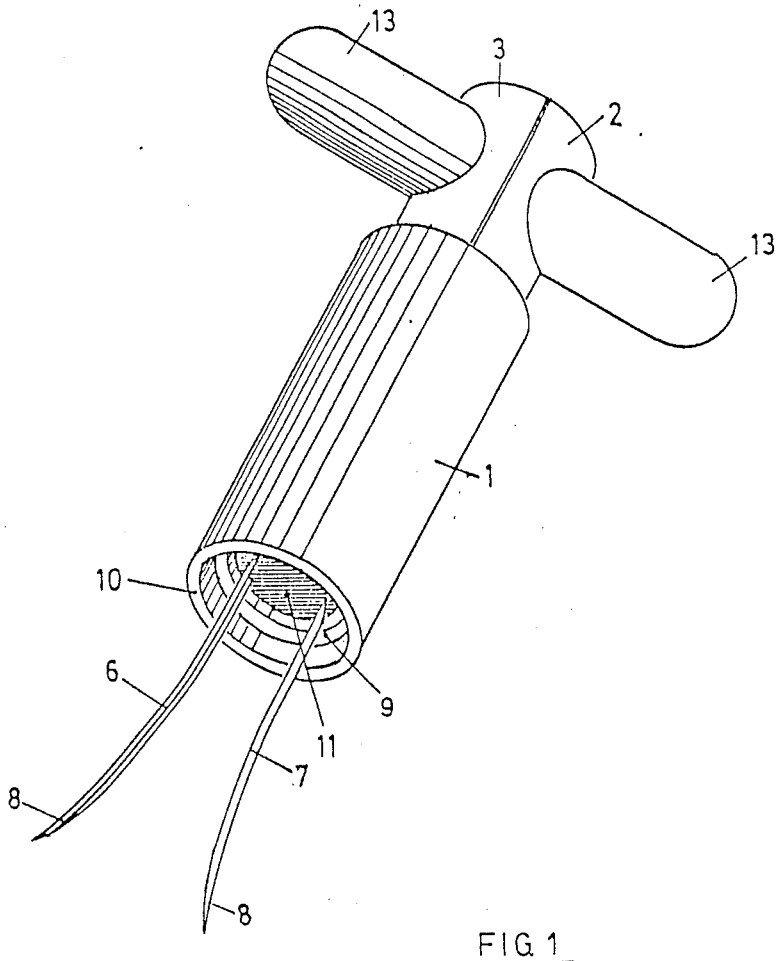
FIG. 1 is an isometric view of a corkscrew.

Numeral 1 designates a guide sleeve within there is movably guided, by suitable guide members 4 and 5 in an axial direction of the guide sleeve 1, a shaft portion having two shaft halves 2 and 3. The guide members simultaneously serve to limit the guide path.

Each shaft half 2 and 3 comprises a metal tongue 6 and 7, respectively. With a spacing corresponding to the diameter of bottle openings and projecting in an axial direction of the guide sleeve, the metal tongues are attached to the shaft halves 2 and 3. They are convexly bulging inwards.

At the end of the guide sleeve 1 which can be applied onto a bottle, there is inserted into the guide sleeve 1 a guide ring 9. This guide ring 9 is somewhat recessed relative to the end of the guide sleeve 1 so that a collar 10 is formed that reaches over the bottle neck. The opening 11 of the guide ring has a diameter that corresponds to the diameter of a bottle opening.

Prior to application onto a bottle head 12, both shaft halves 2 and 3 are pulled upwards by means of the handle tabs 13 provided thereat, the metal tongues 6 and 7 sliding along the interior border of the guide ring 9. The shifting path of the shaft portion is dimensioned such that the free ends 8 of the metal tongues 6 and 7 are approximately in the plane of the guide ring 9 facing the collar 10 if the shaft portion is completely pulled up. Due to the elasticity of the metal tongues 6 and 7, their free ends 8 engage the interior border of the guide ring 9, and owing to the diameter of the opening 11 of the guide ring 9 being adapted to the diameter of the bottle opening, the free ends are in a position in which they can, by operating the respective shaft halves 2 and 3, be introduced between the bottle neck 12 and a cork 14 therein.

Figures 2, 3, 4:
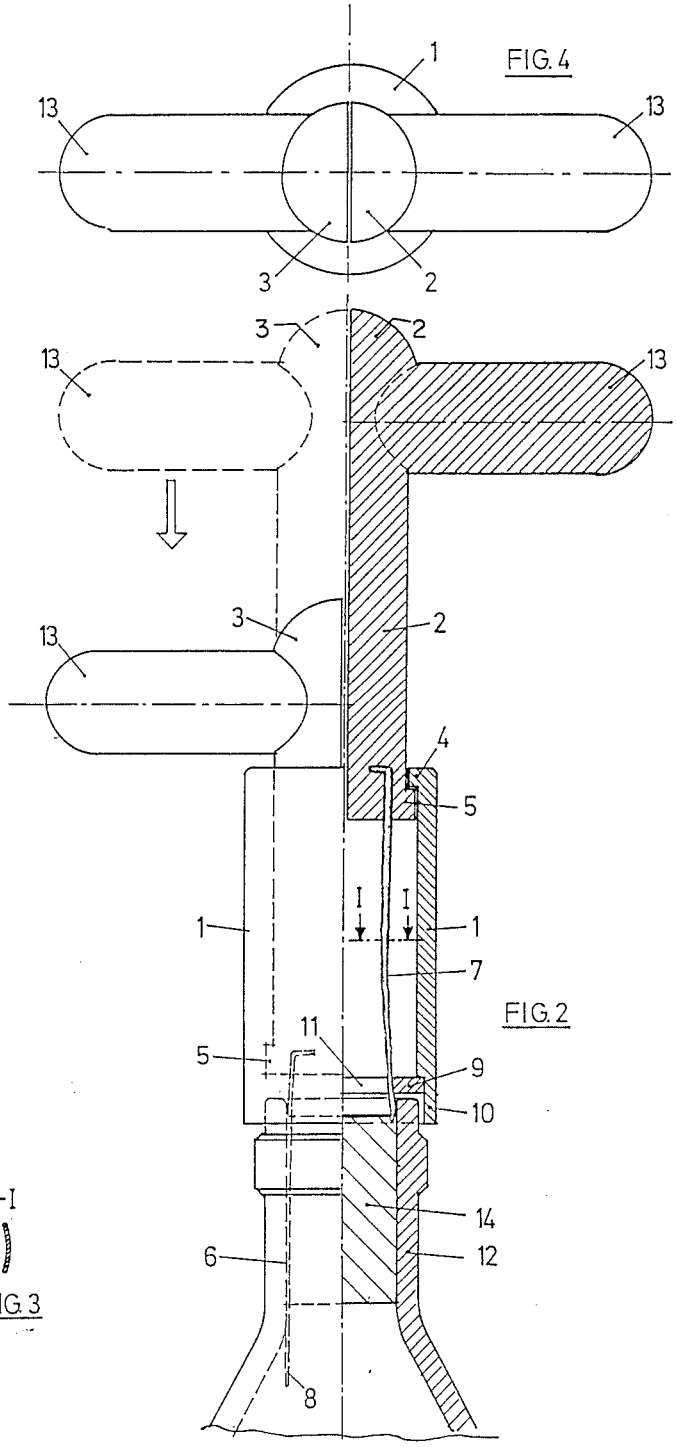
FIG. 2 is a partial side view/sectional view of the corkscrew as applied to a bottle head, one shaft half being shifted downwards, its steel tongue being stuck between bottle neck and cork.
FIG. 3 is a metal tongue cross section along I—I.
FIG. 4 is a top view of FIG. 2.

It will be seen from FIG. 3 that the metal tongues are dished (concavely rounded) relative to their longitudinal axes, the radius of curvature corresponding to about the radius of the bottle opening. For uncorking, the two shaft halves 2 and 3 are pulled up by means of their handle tabs 13 first, the free ends 8 of the metal tongues 6 and 7 being pressed together by the guide ring 9 in accordance with the diameter of the bottle opening. Thereby, an additional jamming force of the metal tongues 6 and 7 towards the cork 14 is achieved so that the latter is definitely pulled up by the metal tongues 6 and 7, in which movement the corkscrew ought to be rotated about its longitudinal axis so that the cork 14 is further loosened in the bottle neck 12. Since the metal tongues 6 and 7 are dished, this greatly facilitates on the hand such a turning of the corkscrew, and on the other hand the cork 14 is definitely grasped since there is a large areas of contact between the cork 14 and the metal tongues 6 and 7.

Using the corkscrew disclosed, a cork can without any damage thereto be quickly pulled out of the bottleneck.

I claim:

1. A cork removing device comprising in combination:

(a) a shaft portion that is longitudinally divided into two shaft halves (2, 3) and that has a top end that terminates in handle tabs (13), (b) a guide sleeve (1)

that is slidably fitted around a bottom end of said shaft portion so that said bottom end of said shaft portion can be slidably moved within said guide sleeves (1), and that contains a centering collar (10) that is adapted to fit onto the neck (12) of a bottle, and (c) two metal tongues (6, 7) which serve as a cork pulling tool that are attached to diametrically opposed halves (2, (3) of said shaft portion, and that are located at a spaced apart distance approximating the diameter of the cork that is to be removed.

2. A corkscrew according to claim 1 wherein within the guide sleeve (1) there is a guide ring (9) which is recessed in an axial direction of the guide sleeve relative to the centering collar (10), the opening (11) of the ring (9) having a diameter that approximates the diameter of the bottle opening.

3. A corkscrew according to claim 1 wherein the metal tongues (6, 7) convexly bulge inwards relative to their longitudinal axes and wherein each metal tongue (6, 7) is dished transversely to its longitudinal axis at a radius corresponding to the radius of the bottle opening.

4. A corkscrew according to claim 1 wherein the metal tongues (6, 7) have conically pointed free ends (8).

* * * * *